United States Patent [19]

Christakos

[11] 4,003,292

[45] Jan. 18, 1977

[54] RIFLE

[76] Inventor: Nicolaos C. Christakos, 2832 N. Austin Ave., Chicago, Ill. 60634

[22] Filed: Sept. 12, 1975

[21] Appl. No.: 612,868

[52] U.S. Cl. ..... 89/145; 89/194; 89/199

[51] Int. Cl.[2] ..... F41C 5/00

[58] Field of Search ..... 89/141, 145, 194, 196, 89/199

[56] References Cited

UNITED STATES PATENTS 900,865 10/1908 Louis ..... 89/145

*Primary Examiner*—Stephen C. Bentley
*Attorney, Agent, or Firm*—Edward C. Threedy

[57] ABSTRACT

A firing mechanism for a semi-automatic rifle that provides a breech block and firing pin, each reciprocally movable simultaneously and independently in response to the firing of the rifle and the action of a pair of expansion springs positioned forwardly of and out of the firing chamber of the rifle.

5 Claims, 15 Drawing Figures

10
11
12
13
14
15
19
20
27
30
31
32
33
34
37
38
43
44
49
54'
60

RIFLE

SUMMARY OF THE INVENTION

This invention is directed to an improvement in the firing mechanism for a rifle that is self-cocking under the action of contained pressure created by the exploding gases of a previously fired round of ammunition.

The improvement is in the actuation of the breach block and firing pin, each of which has simultaneous and independent movement effected in part through the expansion action of a pair of separate coil springs tensioned under the self-cocking action of the rifle.

The construction of the improved firing mechanism of the invention results in fewer movable parts, as well as the readily accessibility of such parts for assembly, cleaning, repair or replacement. As such, the trigger assembly, the breech block and firing pin, as well as their coiled actuating springs, all may be disassembled and reassembled with one simple tool.

The coiled actuating springs which effect the firing of the rifle, are placed forward as well as out of the firing chamber and therefore are removed from any adverse effects of the firing of the rifle.

GENERAL DESCRIPTION

The invention will be best understood by reference to the accompanying drawings, in which.

As this invention is primarily directed to an improved cocking and firing mechanism for a rifle of the type that is automatically cocked by pressure resulting from a previously fired round of ammunition, a system well known in the art, only such components of the rifle are shown as are necessary for a complete understanding of the invention.

Figures 1, 2, 3, 4:
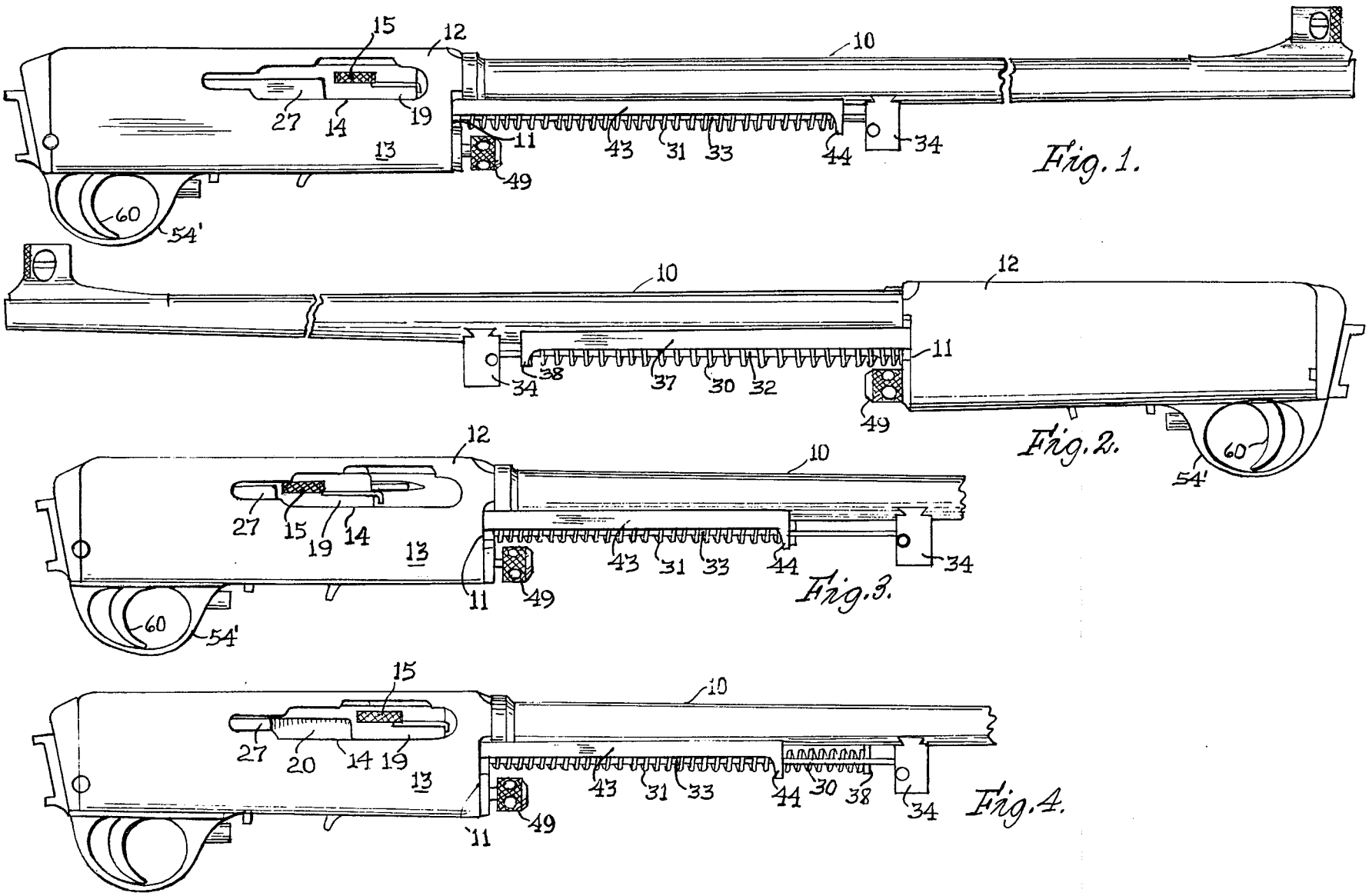
FIG. 1 is a fragmentary side elevational view of the rifle, showing certain parts exposed.
FIG. 2 is a fragmentary side elevational view of the opposite side of the rifle.
FIG. 3 is a side elevational view similar to FIG. 1, but showing certain parts in partially cocked position.
FIG. 4 is a view similar to FIG. 3, showing the parts thereof in full cocked position.
Figures 5, 6, 7:
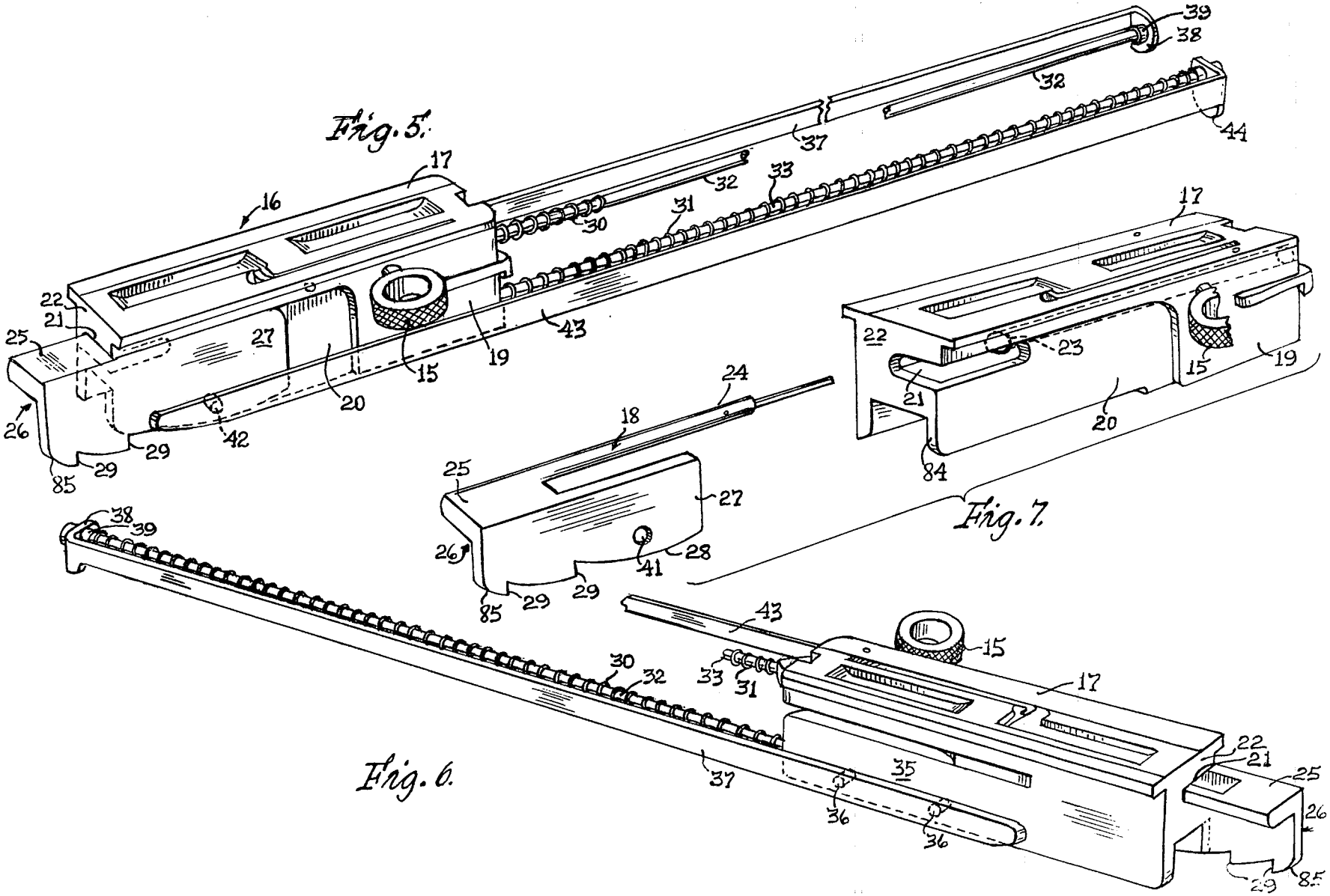
FIG. 5 is a fragmentary perspective view of the breech block and firing pin and the spring actuators therefor.
FIG. 6 is a fragmentary perspective view similar to FIG. 5, showing the opposite side of the parts.
FIG. 7 is a perspective view of the breech block and firing pin in exploded relation.

Therefore, as shown in FIGS. 1 and 2, there is illustrated a barrel 10 threadably connected to the front wall 11 of the breech housing 12. In one side wall 13 of the housing 12 is a breech opening 14 through which a bolt lever 15 extends and out of which a spent cartridge can be expelled. Within the housing 12 is slidably contained a receiver group 16, as shown in FIGS. 5, 6 and 7, consisting of a breech block 17 and firing pin 18. The bolt lever 15 is adapted to be removably attached to one side wall 19 of the breech block 17 in any acceptable manner.

As shown in FIGS. 5 and 7, the side wall 19 of the breech block 17 is partially relieved as at 20. An elongated slot 21 is cut into the end wall 22 of the breech block 17 and has open communication with the relieved section 20 of the side wall 19.

Extending longitudinally through the breech block 17 is a circular passage, the mouth of which is shown at 23 in FIG. 7, and which has open communication with the inner end portion of the slot 21.

The firing pin 18 includes an elongated plunger 24 adapted to be slidably contained in the circular opening formed throughout the block 17. The plunger 24 of the firing pin 18 is carried by a base wall portion 25 which comprises a part of an inverted L-shaped cocking piece 26. The leg side 27 of the cocking piece 26 provides a bottom edge 28 notched so as to provide latch teeth 29.

In assembly the cocking piece 26 and firing pin 18 are carried by the block 17, with the plunger 24 of the firing pin 18 projected into the opening formed throughout the block 17 and with the base wall portion 25 contained within the slot 21 while the leg or side wall 27 of the cocking piece 26 is contained within the relieved portion 20 of the side wall 19 of the breech block 17, as seen in FIGS. 5 through 7.

The receiving group 16 is adapted to be moved in one direction (the cocking action) through the housing 12 by the escaping gas pressure resulting from the firing of a previous round of ammunition. During this motion, both the breech block 17 and firing pin 18 react simultaneously. After a predetermined length of travel, the breech opening 14 is cleared and a spent cartridge is expelled therethrough by a mechanism well known in the art and not made a part of this invention.

The breech block 17 will independently reciprocally move under spring action to its original position as shown in FIG. 1 and will close the breech opening 14 as seen in FIG. 4.

The firing pin 18 and the cocking piece 26 will remain in a cocked position as hereinafter explained.

The means for returning the breech block 17 and the firing pin 18 to their original position (fired condition of the rifle) comprises coil springs 30 and 31. These springs are coiled about guide rods 32 and 33, respectively, which are maintained between a retainer 34 carried by and beneath the barrel 10 and the forward wall 11 of the breech housing 12, as seen in FIGS. 1 and 4.

The breech block 17 has its other side wall 35 formed to provide two circular openings which are adapted to receive corresponding pins 36 carried by the inner wall surface of an actuating rod 37. The forward or free end of the rod 37 terminates into a right angular flange 38 which carries a bushing 39 into which is projected the free end of the rod 32. Thus, the coil spring 30, when the block 17 is positioned within the breech housing 12, will extend between a recessed base 40 (FIG. 15) formed in the front wall 11 of the housing 12 and the angular flange 38 of the actuator rod 37, as seen in FIG. 2.

Figures 8, 9, 10, 11, 12, 13, 14, 15:
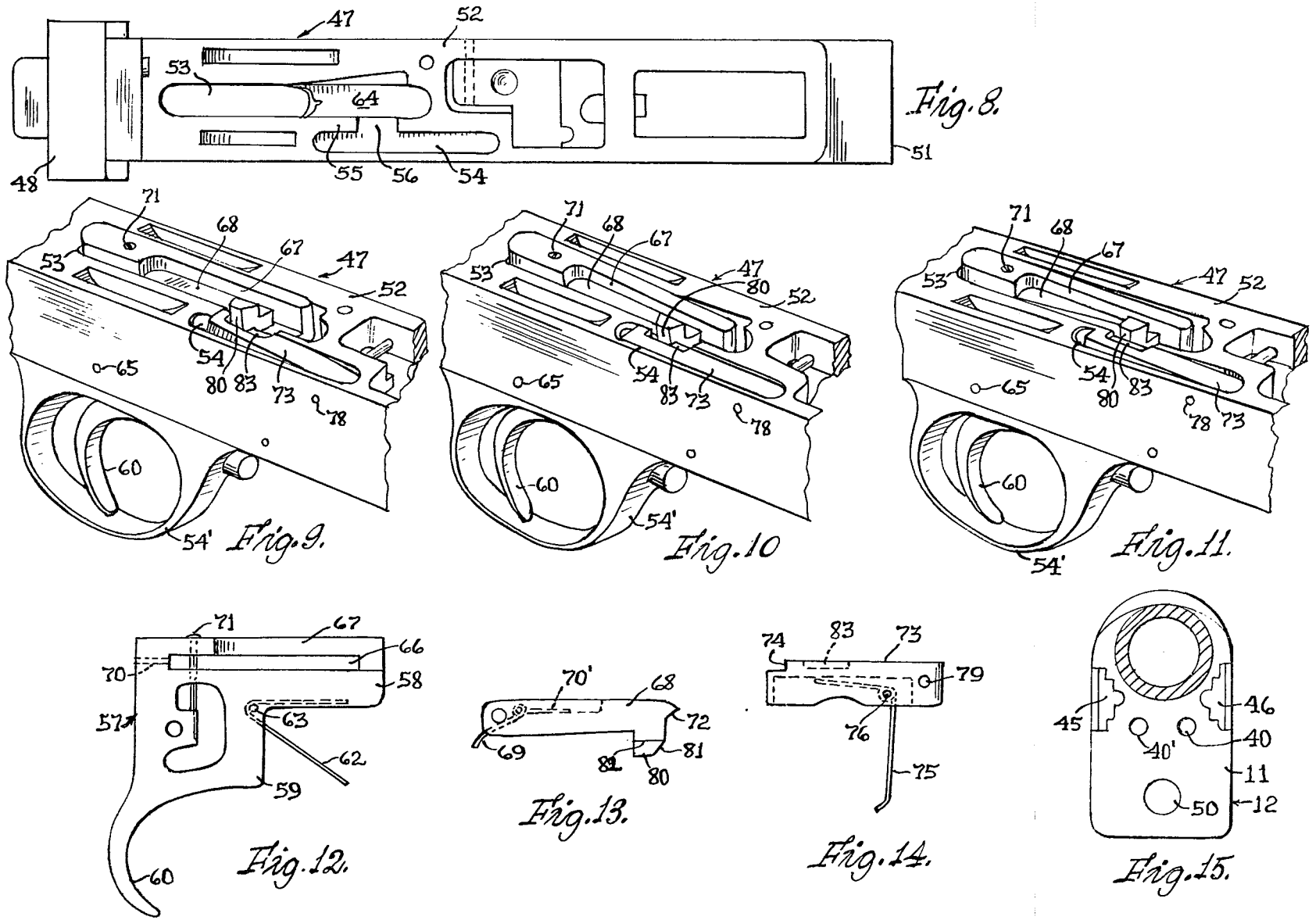
FIG. 8 is a top plan view of the trigger housing of the invention.
FIGS. 9, 10 and 11 are fragmentary perspective views of certain portions of the invention in different operative positions.
FIG. 12 is a side elevational view of the trigger member of this invention.
FIG. 13 is a top plan view of the sear actuator of the invention.
FIG. 14 is a side elevational view of the sear as used in the invention.
FIG. 15 is a fragmentary detailed front elevational view of the breech housing of the invention.

The leg or side wall portion 27 of the cocking piece 26 and firing pin 18 is likewise provided with a circular opening 41 which is adapted to receive a corresponding pin 42 carried by a second actuator rod 43. This rod 43 is of a construction like that of the rod 37 and likewise provides a right angular flange 44 at its free end which restrains one end of its coil spring 31, the other end of the spring extending into the recessed base 40′ (FIG. 15).

From the foregoing, it is readily apparent that the breech block 17 and firing pin and cocking piece 26 are so constructed as to be independently moved by their respective coil springs 30 and 31 in a manner hereinafter made apparent.

In order for the actuator rods 37 and 43 to remain connected to the breech block 17 and firing pin 18 when the latter pieces are contained within the breech housing 12, the front wall 11 of such housing is provided with openings 45 and 46 through which the rods 37 and 43 slidably project.

Forming a bottom closure for the breech housing 12 is a trigger housing 47. This trigger housing 47 provides a back wall 48 to which may be conveniently attached the stock of the rifle (not shown). The trigger housing 48 is connected to the housing 12 through a bolt 19 which is projected through the opening 50 (FIG. 15) formed in the front wall 11 of the housing 12 and which is threadably projected into the front wall 51 of the trigger housing 47.

The trigger housing 47 provides a substantially flat top wall 52 which has an elongated opening 53 cut therethrough which communicates with a trigger guard 54′ formed on the bottom wall of the trigger housing 47. Extending parallel to the opening 53 and slightly forward and to one side thereof is a recess 54, with the wall 55 extending between the opening 53, and the recess 54 being relieved as at 56, all for the purpose of accommodating cooperative components of the trigger assembly hereinafter described.

As seen in FIG. 12, there is shown a trigger 57 consisting of a thin elongated upper body portion 58 as well as a trigger supporting body 59. The trigger 57 is adapted to be placed within the opening 53 formed through the trigger housing 47, such that the finger-piece 60 thereof is contained within the trigger guard 54′, while the upper body portion 58 will extend slightly above the top wall 52 of the trigger housing as shown in FIGS. 9 through 11.

A spring 62 is coiled about a pin 63 carried by the trigger 57 and is caused to sit in a compressed condition upon the base of the recess 64 formed in the trigger housing 47 forwardly of the trigger opening 53, as seen in FIG. 8. By a pin 65 extending through the side walls of the trigger housing 47, the trigger 57 is pivotally positioned within the opening 53 under the tension of the spring 62.

As shown in FIG. 12, the upper body 58 of the trigger 57 is provided with a horizontally extending slot 66 which also has communication with a relieved portion 67 formed in the upper body 58 of the trigger 57.

Positioned within the slot 66 is a sear actuator 68. This sear actuator 68 has a coil spring 69 carried within a slot 70′ formed in one side wall of the sear actuator 68, with the free end of the spring 69 adapted to be placed within a slot 70 formed in one wall of the trigger 57, as shown in FIG. 12. By a pin 71 the sear actuator 68 is connected to the trigger 57 and is positioned within the slot 66 provided thereby. The spring 69 will normally urge the sear actuator 68 laterally through the slot 66 in the direction of the recess 54. The sear actuator 68 provides a stop 72 at one end which is adapted to engage an inner end wall defining the slot 66 so as to prevent the sear actuator 68 under the action of its spring 69 from being urged wholly out of the slot 66 while permitting the same to be moved in an opposite direction through such slot 66 in a manner and for a purpose hereinafter described.

Within the recess 54 there is pivotally contained a sear 73. This sear 73 provides a shoulder 74 formed at one of its upper corners as seen in FIG. 14. The sear 73 is partially hollowed out through the bottom wall thereof so as to house a tension spring 75 coiled about a pin 76. By a suitable pin 78 which extends through the side walls of the housing 47 and which passes through the opening 79 formed in the sear 73, the sear 73 will be urged in an upward direction from the top wall 52 of the trigger housing 47.

The sear actuator 68, as shown in FIG. 13, provides an enlarged wall abutment 80 which has its forward edge chamfered as at 81 and its bottom edge slightly relieved along the line 82. The inner side edge of the sear 73 is recessed as at 83 and normally receives the wall abutment 80 when the parts of the trigger 57 are in their normal condition as shown in FIG. 9.

When the rifle is to be fired for the first time, the operator through the bolt lever 15 will manually retract the breech block 17 and firing pin 18 through the breech housing 12 in a direction from left to right as viewed in FIG. 1. This movement will compress the respective coil springs 30 and 31 by reason of the fact that the actuator rods 37 and 43 will also be moved with the breech block 17. As the parts are moved within the breech housing 12, the forward edge of the wall leg 84 (FIG. 7) of the relieved wall portion of the breech block 17 will engage the chamfered edge 81 of the wall abutment 80 of the sear actuator 68, causing it to be moved laterally through the slot 66 formed in the trigger 57 and out of the recess 83 formed in the upper side edge of the sear 73. In this position the sear actuator 68 is momentarily disengaged from the sear 73. However, simultaneously the forward edge 85 of the wall portion 27 of the cocking piece 26 will ride upon the upper surface of the sear 73, causing the shoulder 74 to be urged in locking engagement with the teeth 29 formed in the bottom edge 28 of such wall portion 27. The rifle will not be fully cocked until the shoulder 74 engages the innermost tooth 29 provided by the cocking piece 26.

Upon release of the bolt lever 15, the coil spring 30 will expand, causing the breech block 17 to move forwardly or in a left to right movement in the breech housing 12, as seen in FIG. 1. When the breech block 17 has returned to its normal position as seen in FIG. 1, it will seal the breech opening 14.

As the breech block 17 returns to its normal position, the edge portion 84 of the relieved wall portion of the breech block 17, will be moved from engagement with the wall abutment 80 of the sear actuator 68. Under tension of its spring 69, the abutment 80 will be moved laterally through the recess 56 formed in the wall 55 and into the recess 83 formed in the upper side edge of the sear 73. At this point, when the trigger is pulled the whole trigger 57 including the sear actuator 68 will be pivoted in a downward direction through the opening 53 formed in the trigger housing 47. By such movement the abutment 80 of the sear actuator 68 will depress the sear 73 against the action of its spring 75 a sufficient distance to disengage the shoulder 74 from the cocking teeth 29.

In this condition, the cocking piece 26 and firing pin 18 is caused to be moved forwardly with respect to the breech block 17 under the expanding action of its coil spring 69. This will cause the plunger 24 of the firing pin 18 to engage the cartridge which has been placed in the firing chamber of the rifle, causing the same to fire.

The cartridge is supplied into the firing chamber through a normal magazine (not shown), but of a construction well known in the art and the operation thereof well known.

The escaping gas of the fired round will cause the automatic firing of the rifle in the same manner as that previously described, with the exception that the operator need not engage the bolt lever 15.

The design of this rifle is such that it is of a semiautomatic type and therefore, while the escaping gases of the previously fired round will cock the rifle, the rifle cannot be continuously fired even though the trigger is held in a firing position. The reason why the rifle will not be continuously fired is that in the event the trigger 57 is held in its pivoted position as seen in FIG. 10 wherein the sear actuator 68 has depressed the sear 73 so as to cause the firing of the rifle, such action will not be accomplished for the following reasons.

In the event the trigger 57 is held in its fired position, the parts thereof will be in the position shown in FIG. 10 prior to the rearward movement of the breech block 17 and firing pin 18 and cocking piece 26. As these latter pieces are moved in one direction rearwardly through the housing 12 by the escaping gas of the previously fired round, the wall portion 84 of the breech block 17 will engage the abutment 80 of the sear actuator 68 and cause the same to be moved laterally out of engagement with the sear 73 into the position as shown in FIG. 11. In such position as shown in FIG. 11, the sear 73 has been permitted to be raised into its upper position where its shoulder 74 will once again engage the teeth 29 of the cocking piece 26 and cock the same. However, as the abutment 80 of the sear actuator 68 is still in its depressed position due to the held position of the trigger 57, it will be displaced laterally and beneath the recess 83 of the sear 73 and therefore cannot cause depression of the sear 73 so as to release the shoulder 74 thereof from the cocking teeth 29 of the cocking piece 26.

Only until the trigger 57 is fully released and again pivots upwardly through the opening 53, will the abutment 80 of the sear actuator 68 moving therewith rise to the point where it will be free under action of its spring 69 to be pivoted into the recess 83 of the sear 73 so as to be able to depress the same when the trigger 57 is once again pivoted.

It should be noted that the actuating springs 30 and 31 are fully disposed out of the firing chamber of the rifle and therefore not subject to any adverse effect of the firing of such rifle. Both such springs and their actuator rods may be conveniently housed in a forestock of the rifle which may be disposed beneath the barrel 10, covering the same.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A self-cocking rifle having a hollow breech housing comprising a firing chamber having open communication with an elongated barrel, wherein the improvement comprises a. a breech block reciprocally movable through the breech housing, b. a firing pin and cocking piece carried by said breech block simultaneously and independently reciprocally movable therewith through the breech housing, c. independent coil springs for independently moving said breech block and said firing pin and cocking piece in one direction through the breech housing, d. means extending into the breech housing and connected to said breech block and to said firing pin and cocking piece, cooperating with said independent coil springs for moving said breech block and said firing pin and cocking piece independently in one direction through the breech housing, e. a sear engaging said firing pin and cocking piece when the latter is moved with said breech block in an opposite direction through said breech housing for cocking the same against the action of its coil spring, f. a trigger assembly for said rifle adapted to be pivoted about an axis transversely to the direction of movement of said breech block and said firing pin and cocking piece, and g. means carried by said trigger assembly for disengaging said sear from said firing pin and cocking piece whereby the latter is moved by its coil spring independently of said breech block in one direction through the breech housing into firing position.

2. A self-cocking rifle as defined by claim 1 wherein said independent coil springs are carried beneath the barrel of said rifle and forwardly and exteriorly of the breech housing and out of the firing chamber of the rifle and adapted to be compressed by movement of said breech block and said firing pin and cocking piece in said opposite direction and expandable so as to independently move said breech block and said firing pin and cocking piece in said one direction.

3. A self-cocking rifle as defined by claim 1 wherein said means for disengaging said sear from said firing pin and cocking piece comprises a sear actuator carried by said trigger and movable therewith, said sear actuator pivotally connected to said trigger so as to be moved transversely to the pivotal movement thereof, and providing an abutment having normal contact with said sear and in the path of movement of said breech block and pivoted thereby out of contact with said sear when said trigger is held in its pivoted position so as to prevent uncocking of said sear from said firing pin and cocking piece.

4. A self-cocking rifle as defined by claim 1 wherein said means connected to said breech block and said firing pin and cocking piece for cooperating with said moving means comprises a pair of parallelly extending actuator rods, one of said rods being connected to said breech block and the other of said rods being connected to said firing pin and cocking piece, each of said rods providing means at their opposite free ends external of the breech housing for engaging said moving means for conditioning the same to independently move said breech block and said firing pin and cocking piece in one direction through the breech housing.

5. A self-cocking rifle as defined in claim 4 wherein said means for disengaging said sear from said firing pin and cocking piece comprises a sear actuator carried by said trigger and movable therewith, said sear actuator pivotally connected to said trigger so as to be moved transversely to the pivotal movement thereof, and providing an abutment having normal contact with said sear and in the path of movement of said breech block and pivoted thereby out of contact with said sear when said trigger is held in its pivoted position so as to prevent uncocking of said sear from said firing pin and cocking piece.

* * * * *